US007052230B2

(12) United States Patent
Beaven et al.

(10) Patent No.: US 7,052,230 B2
(45) Date of Patent: May 30, 2006

(54) PUMP ASSEMBLY

(75) Inventors: Robert William Beaven, Bristol (GB); Michael John Werson, Eastleigh (GB)

(73) Assignee: Automotive Motion Technology Limited (GB)

( * ) Notice: Subject to any disclaimer, the term of this patent is extended or adjusted under 35 U.S.C. 154(b) by 59 days.

(21) Appl. No.: 10/840,495

(22) Filed: May 6, 2004

(65) Prior Publication Data

US 2004/0241016 A1 Dec. 2, 2004

(30) Foreign Application Priority Data

May 8, 2003 (GB) ..... 0310512.9

(51) Int. Cl.
*F01D 1/24* (2006.01)

(52) U.S. Cl. ..... 415/65; 415/71; 415/72; 415/119; 416/122; 416/134 R; 416/176; 417/360

(58) Field of Classification Search ..... 415/65, 415/71, 72, 119, 213.1; 416/122, 134 R, 416/176, 244 R; 417/360, 363
See application file for complete search history.

(56) References Cited

U.S. PATENT DOCUMENTS

| | | | | |
|---|---|---|---|---|
| 2,905,093 | A * | 9/1959 | Raub et al. | 415/180 |
| 2,928,961 | A * | 3/1960 | Morrill | 415/213.1 |
| 3,406,637 | A * | 10/1968 | Perl | 415/213.1 |
| 3,407,747 | A * | 10/1968 | Rule | 417/360 |
| 3,790,309 | A | 2/1974 | Volz | |
| 4,547,135 | A | 10/1985 | Noel et al. | |
| 6,361,293 | B1 | 3/2002 | Harper | |
| 6,499,966 | B1 | 12/2002 | Werson et al. | |

FOREIGN PATENT DOCUMENTS

| | | | |
|---|---|---|---|
| DE | 31 33 331 | A1 | 3/1983 |
| EP | 610826 | A2 * | 8/1994 |
| GB | 1300302 | A | 12/1972 |
| GB | 1434226 | A | 5/1976 |
| GB | 2230051 | A | 10/1990 |
| GB | 2271811 | A | 4/1994 |
| JP | 07-87707 | A | 3/1995 |

OTHER PUBLICATIONS

United Kingdom Search Report issued in priority application GB 0310512.9.

* cited by examiner

*Primary Examiner*—Igor Kershteyn
(74) *Attorney, Agent, or Firm*—Dykema Gossett PLLC

(57) ABSTRACT

A pump assembly including a pump, a pump frame and a motor, the pump including a pumping member which is mounted in a pump housing, relative rotation of the pumping member with respect to the pump housing causing pumping of fluid, and the motor including a rotor and a stator, operation of the motor causing rotation of the pumping member relative to the pump housing, wherein one or two of the stator, pumping member and pump housing is fixed relative to the pump frame, a resilient support part being provided between the pump frame and each of the other two or one of the stator, pumping member, and the pump housing, the resilient support part or parts permitting movement of the stator, pumping member or pump housing with respect to the pump frame.

15 Claims, 3 Drawing Sheets

PUMP ASSEMBLY

This application claims priority to United Kingdom Patent Application No. GB0310512.9 filed May 8, 2003, the entire disclosure of which is incorporated herein by reference

FIELD OF THE INVENTION

The present invention relates to a pump assembly, more particularly to a pump assembly including a pump in which pumping is effected by means of a rotating pumping member, such as a screw pump.

DESCRIPTION OF THE PRIOR ART

In such pumps, the pumping member is mounted for rotation relative to a pump housing. In order to provide maximum pumping efficiency, it is desirable to minimise leakage between the or each pumping member and the housing by ensuring that there is minimum clearance between the rotating pumping member and the housing. Thus, in order to achieve maximum pumping efficiency, it is necessary for the housing, and the pumping member to be manufactured to tight tolerances to ensure that the pumping member is precisely aligned within the housing to permit rotation of the pumping member within the housing whilst achieving minimum clearance between the housing and pumping member. This, of course, increases the cost of manufacturing the pump.

Moreover, where the pump is driven by an electric motor careful alignment of the motor rotor relative to the stator is desirable to ensure that the forces exerted on the motor rotor by the stator are evenly distributed around the rotor.

SUMMARY OF THE INVENTION

According to a first aspect of the invention we provide a pump assembly including a pump, a pump frame and a motor, the pump including a pumping member which is mounted in a pump housing, relative rotation of the pumping member with respect to the pump housing causing pumping of fluid, and the motor including a rotor and a stator, operation of the motor causing rotation of the pumping member relative to the pump housing, wherein one or two of the stator, pumping member and pump housing is/are fixed relative to the pump frame, a resilient support part being provided between the pump frame and each of the other two or one of the stator, pumping member, and pump housing, the resilient support part or parts permitting movement of the stator, pumping member or pump housing with respect to the pump frame.

By virtue of the provision of a resilient support part which permits limited movement of the pumping member or pump housing with respect to the pump frame, misalignment of the pumping member with respect to the pump housing can be accommodated. Consequently, even though the pump is made to tight tolerances in order to achieve good pumping efficiency, minor misalignments can be accommodated. Furthermore, where the resilient support part permits movement of the stator relative to the pump frame, misalignments of the motor rotor relative to the stator may be corrected.

Moreover, the provision of the resilient support part may also reduce the transmission of vibrations from the stator pump housing and/or pumping member to the pump frame, and the amount of noise produced by the pump may thus be reduced.

Preferably the resilient member permits movement of the stator pumping member and/or the pump housing with respect to the pump frame in a direction generally normal to the axis of rotation of the pumping member.

The resilient support part may be provided between the pump frame and pumping member.

The resilient support part may be provided between the pump frame and pump housing.

The resilient support part may be provided between the pump frame and the stator.

The pump may further include an outer housing providing a fluid reservoir, the pump housing being contained within the outer housing.

By virtue of the provision of the pump housing within the fluid reservoir, a pump of compact size may be produced.

The stator may be in fluid communication with fluid in the fluid reservoir.

Fluid in the fluid reservoir may thus flow around the stator, and provide cooling for the stator windings.

The pumping member may be connected to the motor rotor by means of a drive shaft such that the axis of rotation of the pumping member generally coincides with an axis of rotation of the rotor. In this case, the drive shaft is preferably integral with the pumping member.

The pumping member may be mounted at a first end of the drive shaft, and a second, opposite end of the drive shaft may be located in a bearing, the bearing being mounted on the pump frame and configured to engage with the drive shaft to permit rotation of the drive shaft about its longitudinal axis whilst preventing movement of the drive shaft generally parallel to its longitudinal axis and in the opposite direction to the first end of the drive shaft. In this case, a resilient support part may be provided between the bearing and the pump frame.

Preferably the pumping member is provided with at least one generally helical screw thread, and the pump is further provided with at least one auxiliary pumping member which is also mounted for rotation in the housing, the auxiliary pumping member also being provided with a generally helical screw thread which meshes with the screw thread of the main pumping member such that rotation of the main pumping member causes rotation of the auxiliary pumping member.

Pumped fluid is thus carried between the screw threads on one or more rotors such that the liquid is displaced in a direction generally parallel to the axis of rotation of the or each rotor. This type of pump is generally referred to as a screw pump.

Preferably the pump housing is provided with an inlet at a first, inlet, end of the pump housing adjacent to the motor, the drive shaft extending from the pumping member through the inlet port to the motor.

A first end portion of the or each auxiliary pumping member preferably extends from the inlet end of the of the pump housing, and bears against an end plate which is spaced from the pump housing.

The end plate thus provides a bearing for the auxiliary pumping member(s), and spacing the end plate from the pump housing provides a fluid reservoir adjacent the inlet port of the pump housing.

The pump housing is preferably provided with an outlet at a second, outlet, end of the housing, the outlet being adjacent to an outer outlet port provided in the outer housing, wherein both outlets are centred around the axis of rotation of the main pumping member.

As discussed above, in a screw pump, fluid is pumped along the pump in a direction generally parallel to the axis of rotation of the main pumping member. The provision of the outlet in line with the axis of rotation of the main pumping member, thus ensures that the flow of pumped fluid in this direction continues as the high pressure fluid is ejected from the pump. In this way, pressure losses resulting from the ejected fluid being forced to change direction as it exits from the pump are minimised.

Preferably a perforated end plate may be provided between the outlet port in the pump housing and the outer outlet port, second end portions of the main and auxiliary pumping members extending from the outlet end of the pump housing and bearing against the perforated plate.

The perforated plate thus provides a bearing surface for the main and auxiliary pumping members whilst still permitted high pressure fluid to pass from the pump housing to the exterior of the outer housing.

DESCRIPTION OF THE DRAWINGS

Embodiments of the invention will now be described with reference to the accompanying drawings, in which.

DESCRIPTION OF THE PREFERRED EMBODIMENTS OF THE INVENTION

Figure 1:
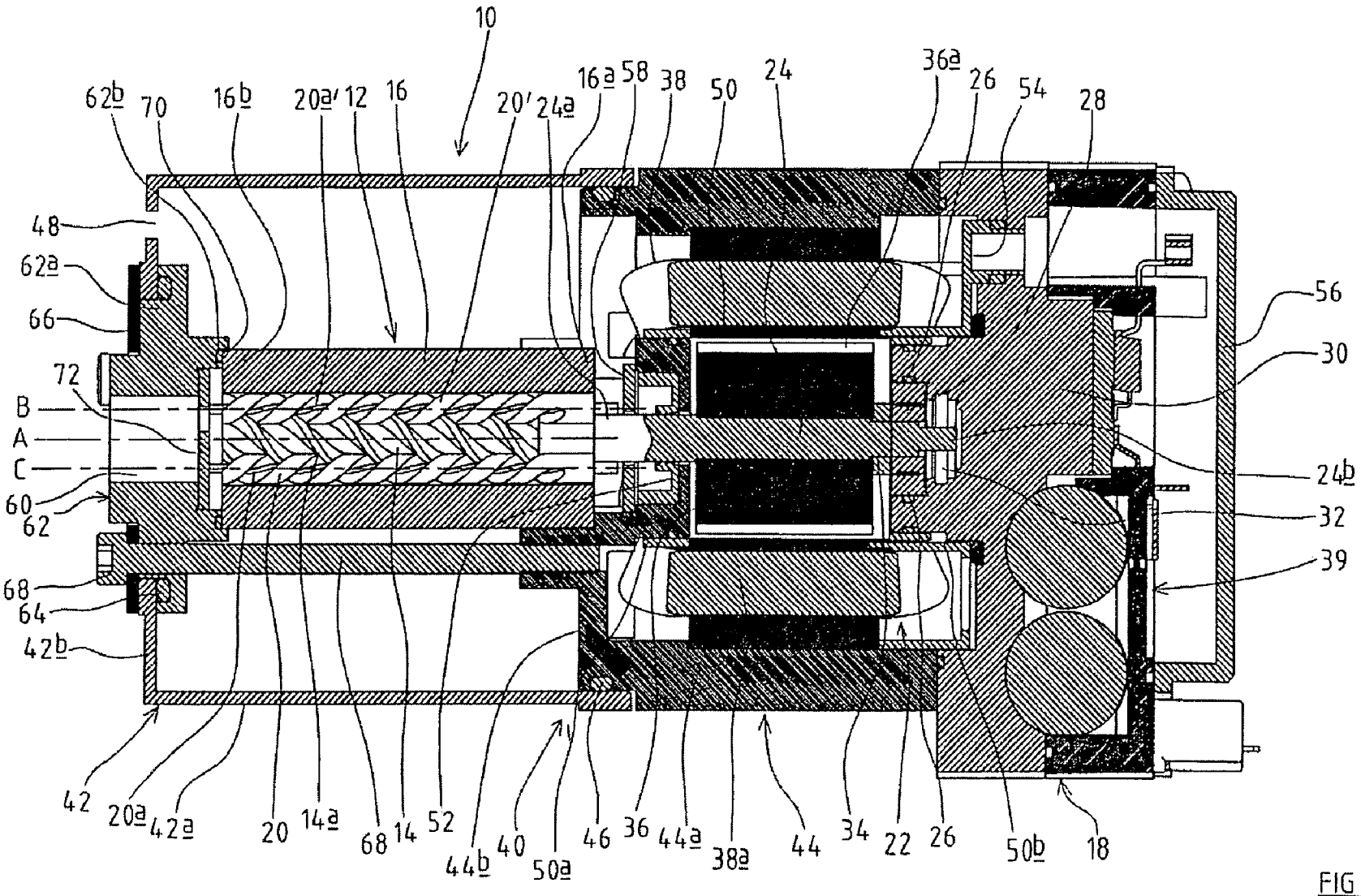
FIG. 1 is a part side sectional illustrative view of a first embodiment of pump assembly according to the invention.
Figure 2:
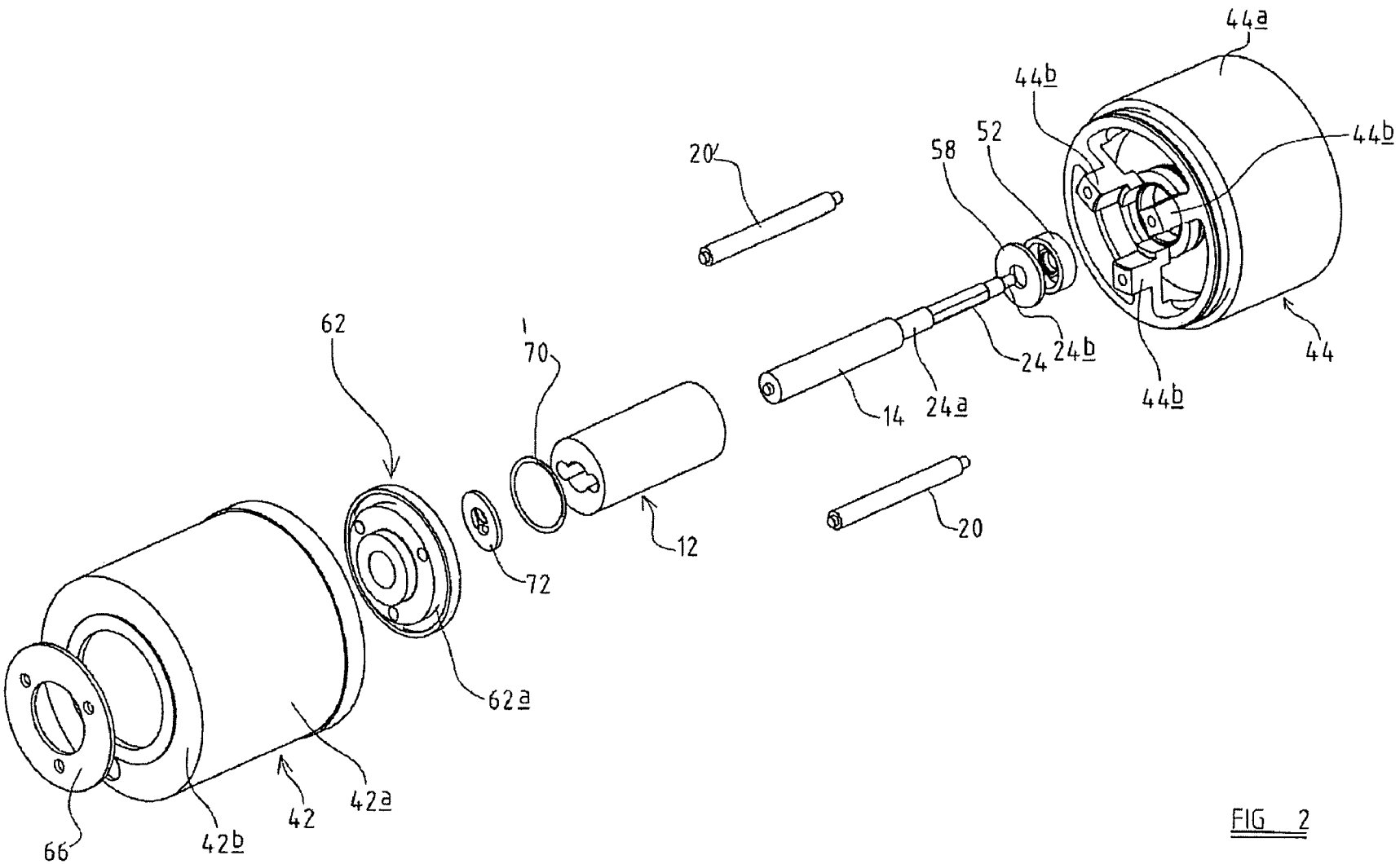
FIG. 2 is an exploded perspective illustrative view of part of the pump assembly of FIG. 1.

Referring now to FIGS. 1 and 2 there is shown a first embodiment of pump assembly 10 including a pump 12, the pump 12 including a main pumping member 14 which is mounted for rotation about its longitudinal axis A in a pump housing 16. The pumping member 14 and pump housing 16 are supported by a pump frame 18.

The main pumping member 14 is connected to a driving means 22, in this example an electric motor, by means of a drive shaft 24, which is integral with the main pumping member 14, such that operation of the motor causes rotation of the main pumping member 14 about axis A. The motor 22 is also supported by the pump frame 18.

In this example, the pump 12 is a screw pump, and thus the main pumping member 14 is an elongate rotor carrying at least one generally helical screw threads 14*a*. Two auxiliary pumping members 20, 20' are provided and are arranged in the pump housing 16 on either side of the main pumping member 14. The auxiliary pumping members 20, 20' are also elongate rotors with longitudinal axes B & C respectively, each of which carries two screw threads 20*a*, 20*a'*. The main pumping member 14 will hereinafter be referred to as the power rotor 14, and the auxiliary pumping members will hereinafter be referred to as idler rotors 20, 20'.

The rotors 14, 20, 20' are arranged in the housing 16, with the power rotor 14 between the two idler rotors 20, 20' such that the screw threads 14*a*, 20*a*, 20*a'* mesh. The longitudinal axes A, B and C of the rotors 12, 14*a* are generally all parallel, and thus rotation of the power rotor 14 about axis A causes the idler rotors 20, 20' to rotate about their longitudinal axes, B and C respectively.

In this example, the rotors 14, 20, 20' are each provided with two generally helical threads or flights 14*a*, 20*a*, 20*a'* which each extend along substantially the entire length of the rotor 14, 20, 20', and which are interposed such that when the rotor 14, 20, 20' is viewed in transverse cross-section, one thread is diametrically opposite the other.

Also in this example, the power rotor 14 has the shape of a generally cylindrical shaft with the threads 14*a* in the form of two generally helical ridges, extending radially outwardly of the shaft. The idler rotors 20, 20' each have the shape of a generally cylindrical shaft with the threads 20*a*, 20*a'*, in the form of two generally helical grooves, extending radially inwardly of each shaft. It is possible, however, for the threads 20*a*, 20*a'* of the idler rotors 20, 20' to have the form of helical ridges, and the threads 14*a* of the power rotor 14 to have the form of generally helical grooves.

The pump housing 16 is generally cylindrical with an aperture for receiving the rotors 14, 20, 20' extending longitudinally of the housing 16 between an inlet end 16*a* and an outlet end 16*a* of the housing 16. The aperture is shaped such that, when contained within the housing 16, the longitudinal axis A, B, C of the rotors 14, 20, 20' extend generally parallel to the longitudinal axis of the housing 16, and there is minimum clearance between the walls of the aperture and the rotors 14, 20, 20' whilst still permitting rotation of the rotors 14, 20, 20' about their axes A, B, C. The aperture is typically formed by machining.

In order to provide maximum pumping efficiency, it is desirable to minimise leakage between the rotors 14, 20, 20' by ensuring that there is minimum clearance between the rotors 14, 20, 20' and the housing 16. Providing such a tight fit between these parts can, however, cause problems if there is misalignment between the rotors 14, 20, 20' and the pump housing 16 when these part are mounted on the pump frame 18, as this may impede rotation of the rotors 14, 20, 20' within the housing 16, or even prevent the rotors 14, 20, 20' from being fitted into the housing 16.

Rather than address the problem presented by such misalignment by increasing the accuracy to which the parts are manufactured, which of course would increase the cost of manufacturing the pump, at least one resilient support part is provided which permits limited movement of the rotors 14, 20, 20' and/or the pump housing 16 with respect to the pump frame 18. By virtue of the provision of such a resilient support part, misalignment of the rotors 14, 20, 20' with respect to the pump housing 16 can be accommodated without the need to increase the accuracy to which the pump assembly is manufactured. Thus the cost of manufacturing the pump may be reduced.

Moreover, the provision of a resilient support part may also reduce the transmission of vibrations from the motor, pump housing 16 and/or rotors 14, 20, 20' to the pump frame 18, and the amount of noise produced by the pump assembly 10 may be reduced.

The configuration of the resilient support part will be described in more detail below.

A first resilient support part 26 is provided between a bearing 28 in which the drive shaft 24 is mounted and the pump frame 18.

The power rotor 14 is mounted at a first end 24*a* of the drive shaft 24, and a second, opposite end 24*b* of the drive shaft 24 is supported in the bearing 28. As indicated above, the drive shaft 24 is integral with the power rotor 14, and its longitudinal axis coincides with the longitudinal axis A of the power rotor 14. The bearing 28 supports the drive shaft 24, whilst permitting rotation of the drive shaft 24 about its longitudinal axis A.

In this example, the bearing 28 is a ball or roller bearing, but it could equally be a plain bearing. The bearing 28 is generally cylindrical and is mounted in a recess 32 in a main body part 30 of the frame. The first resilient support part 26 is an O-ring which is mounted in a groove around the recess 32 so that it extends around the circumference of the bearing 28, and supports the bearing 28. The O-ring 26 is made of a resilient material such as rubber, and thus some movement of the bearing 28, and hence the power rotor 14, with respect to the pump frame 18, normal to the longitudinal axis A of the drive shaft 24, is permitted. In this example, the pump housing 16 is fixed relative to the pump frame 18, as will be described in more detail below, and thus, the provision of resilient support part 26 ensures that slight misalignments of the power rotor 14 relative to the pump housing 16 can be accommodated.

The drive shaft 24 is provided with a step formation 34 adjacent its second end 24*b* and the diameter of the drive shaft 24 decreases across the step formation 34. The bearing 28 thus engages with the step formation 34. The high fluid pressure generated at the power rotor during use of the pump 12 tends to push the power rotor 14 and drive shaft 24 towards the bearing 28, but movement of the drive shaft 24 parallel to its longitudinal axis A and in this direction is thus prevented by the step formation 34. Moreover reduction in the diameter of the drive shaft 24 at its second end 24*b* reduces the area over which the high fluid pressure acts, and therefore decreases the force exerted by the drive shaft 24 on the bearing 28.

The motor 22 includes a rotor 36 which is generally cylindrical and which has a plurality of magnets 36*a* mounted around its circumference, and a stator 38, which includes a plurality of conductive windings 38*a* and which is arranged coaxially with and radially outwardly of the rotor 36. In this example, the stator 38 is fixed relative to the pump frame 18, but it will be appreciated that a resilient support part may be provided between the stator 38 and the pump frame 18 to permit limited movement of the stator 38 relative to the pump frame 18. This would assist in accommodating misalignment of the stator 38 with respect to the motor rotor 36, and would be particularly advantageous where the rotor 36 fixed relative to the pump frame 18. Any type of electric motor may be provided, and the motor may, for example, be a brushless DC motor.

A central portion of the drive shaft 24 is connected to the rotor 36 of the motor 22, such that rotation of the rotor 36 causes rotation of the drive shaft, which in turn causes rotation of the power rotor 14, about its longitudinal axis A. The transverse cross-section of the drive shaft 24 is generally circular, but in the central portion which engages with the rotor 36, two opposite flat sides are provided, and these engage with corresponding flats on the rotor 36 such that rotation of the rotor 36 with respect to the drive shaft 24 is prevented.

The motor 22 may be controlled using an electronic control unit 39 which, in this example, is mounted on the main body part 30 of the pump frame 18, preferably by means of bolts (not shown). In this example, the main body part 30 is relatively massive, and cast from aluminium, and therefore forms a sink for heat generated in the control unit 39. A cover 56 is mounted on the electronic control unit, preferably by means of bolts, to provide protection for sensitive components in the control unit 39 from environmental and mechanical damage.

The pump assembly further includes an outer housing 40 which provides a fluid reservoir, the pump housing 16 being contained within the outer housing 40. The outer housing 40 includes a first housing part 42 and a second housing part 44. The second housing part 44 is fixed relative to the pump frame 18.

The first housing part 42 includes a side wall 42*a* which partially encloses a generally cylindrical space in which is located the pump housing 16, and an annular end portion 42*b*, which extends radially inwardly of a first end of the side wall 42*a*. The second housing part 44 also includes a side wall 44*a* which partially encloses a generally cylindrical space, in which is located the motor 22, and three support formations 44*b* which extend radially inwardly from a first end of the side wall 44*a* and which are spaced at generally regular intervals around the side wall 44*a*.

The inlet end 16*a* of the pump housing 16 is rigidly supported by the three support formations 44*b* of the second housing part 44. Thus, in this example, the pump housing 16 is fixed relative to the pump frame 18.

By enclosing the pump housing 16 in the outer housing 40, the overall length of the pump assembly is decreased compared to a pump assembly in which the fluid reservoir is provided adjacent to the pump housing 16, and particularly compact pump assembly is produced. This is particularly advantageous in applications where space is restricted, such as in automotive applications where space in an engine compartment is limited.

A second end of the first housing part 42 is connected to the first end 44*a* of the second housing part 44. The outer diameter of the second housing part 44 decreases via a step formation adjacent the first end of the side wall 44*a*, and an O-ring 46 is mounted in a groove provided in an outer face of smaller diameter portion of the side wall 44*a*. The second end of the first housing part 42 extends around the first end of the side wall 44*a* and engages with the O-ring 46, the O-ring 46 thus providing a substantially fluid tight seal between the first 42 and second 44 housing parts.

In use, the outer housing 40 is filled with fluid via an aperture provided in the annular end portion 42*b* of the first housing part 42—the assembly inlet 48. The fluid flows around the three support formations 44*b* and into the space enclosed by the side wall 44*a* of the second housing part 44. Thus, the fluid in the fluid reservoir provided by the outer housing 40 flows around the windings 38*a* of the stator 38, and may thus assist in cooling the windings.

The rotor 36 is, however, sealed from the fluid by means of a sealing tube 50 which partially encloses a generally cylindrical space in which is located the rotor 36.

A first end 50*a* of the sealing tube 50 is closed by means of a sealing lip assembly 52 which is mounted on the three support formations 44*b* of the second housing part 44, and which extends radially inwardly of the seal tube 50 to provide a substantially fluid tight seal with the drive shaft 24 whilst permitting rotation of the drive shaft 24 about its longitudinal axis A. A substantially fluid tight seal between the sealing lip assembly 52 and the sealing tube 50 is provided by means of an O-ring mounted in a groove in an outer surface of the sealing lip assembly 52 which engages with an inner surface of the sealing tube 50.

A second end 50*b* of the sealing tube 50 is closed by means of a radially outwardly extending engagement portion 54 which engages with O-rings mounted in the main body part 30 of the pump frame 18 to provide a substantially fluid tight seal.

Adjacent the lip seal assembly 50 and supported by the three support formations 44*b* is an annular end plate 58 through which the drive shaft 24 extends. A first end portion 20*b*, 20*b*' of each idler rotor 20, 20' extends from the inlet end 16*a* of the of the pump housing 16, and bears against the end plate 58 which is spaced from the pump housing 16.

The end plate 58 thus provides a bearing for the idler rotors 20, 20' at the inlet end 16*a*, and spacing the end plate 58 from the pump housing 16 provides a fluid reservoir adjacent the inlet end 16*a* of the pump housing 16.

The outlet end 16*b* of the pump housing 16 is adjacent an outlet port 60 provided in the end portion 42*b* of the first housing part 42. The outlet port 60 is a generally circular aperture which is provided in a generally annular outlet end support part 62. The outlet port 60 is generally centred about the axis of rotation A of the power rotor 14, and therefore there is no pressure loss due to fluid flowing out of the pump housing 16 being forced around corners whilst being expelled from the pump 12.

The outlet end support part 62 includes a radially outwardly extending sealing lip 62*a* in which is provided a groove retaining an O-ring 64. The outlet end support part 62 is mounted on the end portion 42*b* of the first housing part 42 such that the O-ring 64 bears against an inside surface of the end portion 42*b* and provides a substantially fluid tight seal between the outlet end support part 62 and the first housing part 42. The outlet end support part 62 is retained in this position by means of an annular clamping plate 66 which is mounted on an exterior surface of the end portion 42 of the first housing part 42 by means of three retaining bolts 68 which each extend through apertures provided in the clamping plate 66, the end portion 42, and the sealing lip 62*a* and engage with a threaded aperture provided in one of the three support formations 44*b* of the second housing part 44, such part of the end portion 42*a* is clamped between the clamping plate 66 and the outlet end support part 62.

The outlet end support part 62 further includes an axially extending support ledge 62*a* which extends around the entire circumference of the outlet port 60 and which has an axially extending surface on which an exterior surface of the outlet end 16*a* of the pump housing 16 rests and a radially inwardly extending surface against which the outlet end 16*a* of the pump housing 16 is pressed. A rubber O-ring 70 is provided between the radially inwardly extending surface and the pump housing 16, is mounted in a retaining groove in the radially inwardly extending surface. In this example, the pump housing 16 engages with the outlet end support part 62 and thus the O-ring 70 merely provides a seal between the pump housing 16 and the outlet end support part 62, and movement of the pump housing 16 relative to the pump frame 18 is not permitted. The O-ring 70 may, however, support the pump housing 16 and thus form a second resilient support part which permits limited movement of the pump housing 16 with respect to the pump frame 18 in a direction generally parallel to the axis of rotation A of the power rotor 14, and thus assists in accommodating misalignment in this direction.

A further resilient support part may be provided between the axially extending surface of the support ledge 62*b* in order to permit limited movement of the outlet end 16*b* of the pump housing 16 with respect to the pump frame 18, and thus to accommodate misalignment, in a direction generally normal to the axis of rotation A of the power rotor 14.

In addition, or alternatively, resilient support parts may be provided between the support formations 44*b* of the second housing part 44 in order to facilitate movement of the inlet end 16*a* of the pump housing 16 with respect to the pump frame 18.

A perforated end plate 72 is also supported by the support ledge 62*b* between the outlet end 16*b* of the pump housing 16 and the outlet port 60, and spaced from the outlet end 16*b* of the pump housing 16. Second end portions of the power rotor 14 and idler rotors 20, 20' extend from the outlet end 16*b* of the pump housing 16 and bear against the perforated end plate 72.

The perforated plate thus provides a bearing surface for the rotors 14, 20, 20' whilst still permitted high pressure fluid to pass from the pump housing 16 to the exterior of the outer housing 40.

The pump assembly is operated as follows.

The motor 22 is activated to cause rotation of the power rotor 14 about axis A, which in turn causes rotation of the idler rotors 20, 20' in the housing 16 about axes B and C respectively. Fluid is drawn into the inlet end 16*b* of the pump housing 16 between the threads 14*a*, 20*a*, 20*a*' at the first ends of the rotors 14, 20, 20'. As the rotors 14, 20, 20' turn, the meshing of the threads 14*a*, 20*a*, 20*a*' produces fluid chambers bounded by the threads 14*a*, 20*a*, 20*a*' and the pump housing 16. Fluid becomes trapped in the fluid chambers and continued rotation of the rotors 14, 20, 20' causes the fluid chambers to move from the first end of the rotors 14, 20, 20' to the second end of the rotors 14, 20, 20'. High pressure fluid is thus ejected from the pump housing 16 at the outlet end 16*b* as a consequence of fluid being displaced from the fluid chambers as the screw threads 14*a*, 20*a*, 20*a*' at the second end of the rotors 14, 20, 20' mesh. The high pressure fluid then passes through the perforations in the perforated end plate 72, through the outlet port 60 and out of the outer housing 40.

Thus, fluid is pumped along the pump 12 in a direction generally parallel to the axis of rotation A of the power rotor 14. The provision of the outlet port 60 in line with the axis of rotation A of the power rotor, thus ensures that the flow of pumped fluid in this direction continues as the high pressure fluid is ejected from the outer housing 40. In this way, pressure losses resulting from the ejected fluid being forced to change direction as it exits from the pump are minimised.

Figure 3:
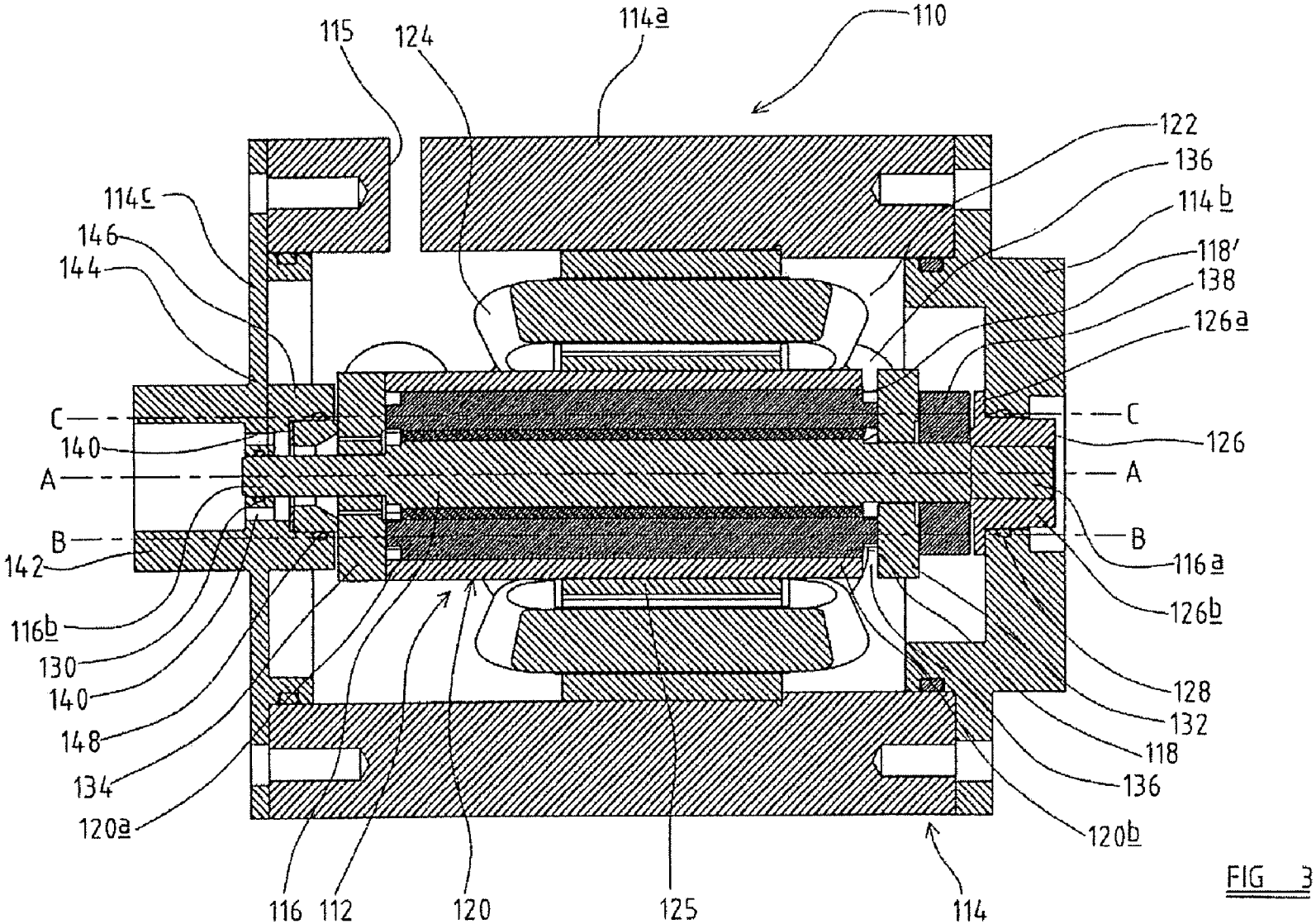
FIG. 3 is a part side sectional illustrative view of a second embodiment of pump assembly according to the invention.

Referring now to FIG. 3, there is shown a second embodiment of pump assembly 110 including a pump 112 and a pump frame which form an outer housing, the outer housing 114 providing a fluid reservoir. The pump 112 includes a plurality of rotors 116, 118, 118' mounted in a pump housing 120 for rotation relative to the pump housing 120, the rotors 116, 118, 118' each carrying at least one screw thread, the rotors being arranged in the pump housing 120 such that the screw thread mesh, and rotation of one of the rotors 116, 118, 118 ' causes rotation of the other rotors 116, 118, 118'.

The outer housing 114 includes a side wall 114*a* which encloses a generally cylindrical space, and first 114*b* and second 114*c* end plates which partially close the first and second ends of the side wall 114*a* respectively. The end plates 114*b*, 114*c* are connected to the side wall 114*a* by means of a plurality of bolts (not shown) which are spaced around the circumference of the side wall 114*a*. The pump housing 120 is enclosed within the outer housing 114.

An inlet port 115 is provided in the side wall 114*a* of the outer housing 114 adjacent to the second end plate 114*c*.

By virtue of the provision of the pump housing 120 within the outer housing 114, the pump assembly 110 is relatively compact and is thus suited for use in applications where space is restricted.

In this example, three rotors 116, 118, 118' are provided—a central rotor 116 and two outer rotors 118, 118'. The rotors 116, 118, 118 ' are elongate with longitudinal axes A, B, and C respectively, and each carries a screw thread.

The rotors 116, 118, 118' are arranged in the pump housing 120, with the central rotor 116 between the two outer rotors 118, 118 ' such that the screw threads mesh. The longitudinal axes A, B and C of the rotors 116, 118, 118' are generally all parallel, and thus rotation of the central rotor 116 relative to the pump housing 120 about axis A causes the outer rotors 118, 118' to rotate about their longitudinal axes, B and C respectively.

In this example, the rotors 116, 118, 118' are each provided with two generally helical threads which each extend along substantially the entire length of the rotor 116, 118, 118', and which are interposed such that when the rotor 116, 118, 118' is viewed in transverse cross-section, one thread is diametrically opposite the other.

Also in this example, the central rotor 116 has the shape of a generally cylindrical shaft with the threads in the form of two generally helical ridges, extending radially outwardly of the shaft. The outer rotors 118, 118' each have the shape of a generally cylindrical shaft with the threads, in the form of two generally helical grooves, extending radially inwardly of each shaft. It is possible, however, for the threads of the outer rotors 118, 118' to have the form of helical ridges, and the threads of the central rotor 116 to have the form of generally helical grooves.

The pump housing 120 is generally cylindrical with an aperture for receiving the rotors 116, 118, 118' extending longitudinally of the housing 120 between an inlet end 120*a* and an outlet end 120*a* of the housing 120. The aperture is shaped such that, when contained within the housing 120, the longitudinal axis A, B, C of the rotors 116, 118, 118' extend generally parallel to the longitudinal axis of the housing 120, and there is minimum clearance between the walls of the aperture and the rotors 116, 118, 118' whilst still permitting rotation of the rotors 116, 118, 181' about their axes A, B, C. The aperture is typically formed by machining.

First 116*a* and second 116*b* end portions of the central rotor 116 extend from the pump housing 120 and engage with the first 114*b* and second 114*c* end plates of the outer housing 114, thus preventing rotation of the central rotor 116 about its longitudinal axis relative to the outer housing 114.

The first end portion 116*a* of the central rotor 116, which extends from the inlet end 120*a* of the pump housing 120, is mounted in a support collar 126 which is received in an aperture provided in the first end plate 114*b* of the outer housing 114. The support collar 126 is received in a generally circular aperture in the first end plate 114*b* and has an radially outwardly extending flange part 126*a* which extends from an end of the support collar to engage with a surface of the first end plate 114*b* which is inside the outer housing 114, the flange part 126*a* thus preventing the support collar 126 from being pushed out of the aperture in the first end plate 114*b* from inside the outer housing 114*a*. The first end 116*a* of the central rotor 116 is mounted in an aperture in a main body part 126*b* of the support collar 126. The aperture and first end 116*a* of the central rotor 116 are both provided with at least one flat surface when viewed in transverse cross-section and thus rotation of the central rotor 116 about its longitudinal axis A relative to the support collar 126 is prevented.

In this example, a first resilient support part 128 is provided between the support collar 126 and the end plate 114*b*, which in this example is a rubber O-ring which is mounted in a groove provided in the first end plate 114*b* around the circumference of the support collar receiving aperture. The support collar 126 is supported by the O-ring 128, and thus, by deformation of the O-ring, some movement of the support collar 126 relative to the outer housing 114 in any direction normal to the longitudinal axis A of the central rotor 16 is permitted.

The second end 116*b* of the central rotor 116, which extends from the outlet end 120*b* of the pump housing 120, is mounted in a generally circular aperture provided in the second end plate 114*c* of the outer housing 114. A second resilient support part 130 is provided between the second end 116*c* of the central rotor 116 and the second end plate 114*c* to permit some movement of the central rotor 116 with respect of the outer housing 114. In this example, the second resilient support part 130 is also a rubber O-ring, which is located in a groove provided in the second end plate 114*c* around the circumference of the central rotor receiving aperture. The second end portion 116*b* of the central shaft 116 is supported by the O-ring 130 and thus, by deformation of the O-ring 130, some movement of the central rotor 116 relative to the outer housing 114 in any direction normal to the longitudinal axis A of the central rotor 116 is permitted.

The provision of such resilient support parts 128, 130 may reduce transmission of vibrations from the pump rotors 116, 118, 118' to the outer housing 114, and may thus reduce the noise generated by the pump assembly 110. In addition, any mechanical misalignment of the central rotor 116 with respect to the remainder of the pump assembly 110 can be accommodated by deformation of the resilient support parts 128, 130. The resilient support parts 128, 130 also provide a substantially fluid tight seal between the central rotor 116 and the outer housing 114.

First 132 and second 134 generally annular pump end plates are provided at the inlet 120*a* and outlet 120*b* ends of the pump housing 120, the first 116*a* and second 116*b* end portions of the central rotor 116 extending through a generally central aperture in each.

In this example, the first pump end plate 132 is connected to the inlet end 120*a* of the pump housing 120, typically by means of bolts. Sufficient clearance is provided between the first end plate 132 and the central rotor 116 so that rotation of the housing 120 with respect to the central rotor 116 about the longitudinal axis A of the central rotor 116 is permitted.

An annular ball or roller bearing 138 is mounted around the first end portion 116*a* of the central rotor 116 between the first pump end plate 132 and the support collar 126, and thus prevents movement of the pump housing 120 with respect to the central rotor 116 towards the first end plate 114*b* of the outer housing 114. The bearing 138 includes a first race which is located around the central rotor 116, and a second race, against which the first end plate 132 of the pump housing 120 bears. A step is provided in an exterior surface of the first end plate 132 so that the first end plate 132 bears only on the second race, and does not contact the first race. The second race may thus rotate about the longitudinal axis A of central rotor 116 with the pump housing 120 whilst the first race is stationary, or alternatively, both races may rotate with the pump housing 120.

Inlet apertures 136 are provided at intervals around the circumference of the pump housing 120 between the inlet end 116*a* of the pump housing 120 and the first pump end plate 132, which permit fluid to flow from the fluid reservoir to the pump rotors 116, 118, 118'.

The second pump end plate 134 is connected to the outlet end 120*a* of the pump housing 120, also typically by means of bolts.

The ends of the outer rotors 118, 118' bear against the two pump end plates 132, 134, and thus the pump end plates 132, 134 provide plain bearings for the outer rotors 118, 118'. Moreover, the start and end of each thread provided on the rotors 116, 118, 118' is spaced from each end of the rotors 116, 118, 118'. Spacing of the threads from the pump end plates 132, 134 results in the formation of fluid reservoirs at the inlet 120*a* and outlet 120*b* ends of the pump housing 120.

A plurality of outlet apertures are provided in the second pump end plate 134, which extend through the second pump end plate 134 generally parallel to the longitudinal axis A of the central rotor 116. These apertures are in line with a plurality of outlet ports 140 provided in the second end plate 114*c* of the outer housing 114, the outlet ports 140 being arranged in a generally circular array around the second end 116*b* of the central rotor 116. An outlet tube 142 extends from the second end plate 114*c* of the outer housing 114 around the outlet ports 140 in a direction generally parallel to the longitudinal axis of the central rotor 116.

Between the second pump end plate 134 and the second end plate 114*c* of the outer housing 114 there is provided a generally annular mechanical sealing element 144 which is adapted to direct fluid flowing from the outlet end 120*b* of the pump housing 120 to the outlet ports 140 in the outer housing 114 and to limit, if not prevent, flow of fluid from the outlet end 120*b* of the pump housing 120 into the fluid reservoir provided by the outer housing 114.

The sealing element 144 is mounted on a mounting ring 146 provided on an interior surface of the second end plate 114*c* of the outer housing 114 around the outlet ports 140. An O-ring 148 is mounted in a groove provided around a radially inwardly facing surface of the mounting ring 146, and the O-ring bears upon a radially outwardly facing surface of the sealing element 144 to provide a substantially fluid tight seal. The radially inwardly facing surface of the sealing element 144 is spaced from the central rotor 116 so that fluid may flow around the central rotor 116 to the outlet ports 140. An end surface of the sealing element 144 bears against the second pump end plate 134 and thus provides a seal which substantially prevents fluid expelled from the pump housing 120 from returning to the fluid reservoir. It is not necessary for there to be a completely fluid tight seal, but the seal should typically permit only a small amount of fluid leakage, 1% or less for example.

Driving means 122, in this example an electric motor, is provided to drive rotation of the rotors 116, 118, 118'. The electric motor 122 includes a stator 124 which is provided with a plurality of electrically conductive windings arranged around and generally coaxially with the pump housing 120. In this example, the stator is fixed relative to the outer housing 114. A plurality of magnets are mounted around an outer surface of the pump housing 120 and thus the pump housing 120 forms the motor rotor.

It will be appreciated that, by virtue of the provision of the resilient support parts 128, 130, any misalignment of the motor rotor with respect to the stator 124 can be accommodated. The central rotor 116 may, however, be fixed relative to the outer housing 114, in which case such misalignment may be accommodated by providing at least one resilient support part between the stator 124 and the outer housing 114.

Integrating the pumping housing 120 with the motor rotor further decreases the size of the pump assembly 110.

The motor 122 is enclosed by the outer housing 114, and fluid in the fluid reservoir provided by the outer housing 114 may thus flow over and around motor stator 124 and rotor 120. Thus, the electrically conductive windings of the stator 124 may be cooled by the fluid in the fluid reservoir. Furthermore, by virtue of positioning the inlet port 115 in the outer housing 114 adjacent to the second end plate 114*c*, i.e. adjacent the outlet end 120*b* of the pump housing 120, fluid that is drawn into the outer housing 114 during operation of the pump 112 passes over the stator windings before entering the pump housing 120.

The pump assembly is operated as follows.

Activation of the motor 122 causes the motor rotor, i.e. the pump housing 120, to rotate about the central rotor 116. Such rotation of the pump housing 120 causes rotation of the outer rotors 118, 118' about the longitudinal axis A of the central rotor 116. As described above the screw threads provided on the outer rotors 118, 118' mesh with the screw threads on the central rotor 116, and as result, the outer rotors 118, 118' are forced to rotate about their longitudinal axes B, C in addition to rotating about the longitudinal axis A of the central rotor 116.

The consequent meshing and unmeshing of the screw threads causes fluid to be drawn into the inlet end 120*a* of the pump housing 120 between the threads at the first ends of the rotors 116, 118, 118'. As the rotors 116, 118, 118' turn, the meshing of the threads produces fluid chambers bounded by the threads and the pump housing 120. Fluid becomes trapped in the fluid chambers and continued rotation of the rotors 116, 118, 118' causes the fluid chambers to move from the first end of the rotors 116, 118, 118' to the second end of the rotors 116, 118, 118'. High pressure fluid is thus ejected from the pump housing 120 at the outlet end 120*b* via the apertures in the second pump end plate 134, as a consequence of fluid being displaced from the fluid chambers as the screw threads at the second end of the rotors 116, 118, 118' mesh. The high pressure fluid then passes through mechanical sealing element 144 around the central rotor 16, through the outlet ports 140 and out of the outer housing 114.

Thus, fluid is pumped along the pump 112 in a direction generally parallel to the axis of rotation A of the central rotor 114. The provision of the outlet ports 140 generally in line with the axis of rotation A of the central rotor 116, thus ensures that the flow of pumped fluid in this direction continues as the high pressure fluid is ejected from the outer housing 114. In this way, pressure losses resulting from the ejected fluid being forced to change direction as it exits from the pump 112 are minimised.

Owing to its compact design, a pump assembly 10,110 according to the invention is particularly useful in applications where high output pressure is required and space is restricted, such as in automotive applications, for example as an electrically operated power pack in which the pump 12, 120 is activated to produce pressurised fluid and the pressurised fluid is used to move an actuator member. Such an electrically powered power pack may be required for applications such as power steering, or system actuation.

Whilst in this example, the pump is a screw pump, the invention may also be applied in any other form of pump where pumping is effected by a pumping member which rotates in a pump housing, and where minimum clearance between the pump housing and the rotating pumping member is required.

We claim:

1. A pump assembly including a pump, a pump frame and a motor, the pump including a pumping member which is mounted in a pump housing, relative rotation of the pumping member with respect to the pump housing causing pumping of fluid, and the motor including a rotor and a stator, operation of the motor causing rotation of the pumping member relative to the pump housing, wherein one or two of the stator, pumping member and pump housing is/are fixed relative to the pump frame, a resilient support part being provided between the pump frame and each of the other two or one of the stator, pumping member, and pump housing, the resilient support part or parts permitting movement of the stator, pumping member or pump housing with respect to the pump frame wherein the pumping member is provided with at least one generally helical screw thread, and the pump is further provided with at least one auxiliary pumping member which is also mounted for rotation in the housing, the auxiliary pumping member also being provided with a generally helical screw thread which meshes with the screw thread of the main pumping member such that rotation of the main pumping member causes rotation of the auxiliary pumping member.

2. A pump assembly according to claim 1 wherein the or each resilient support part permits movement of the stator, pumping member, or pump housing with respect to the pump frame in a direction generally normal to the axis of rotation of the pumping member.

3. A pump assembly according to claim 1 wherein a resilient support part is provided between the pump frame and the pumping member.

4. A pump assembly according to claim 1 wherein a resilient support part is provided between the pump frame and the pump housing.

5. A pump assembly according to claim 1 wherein a resilient support part is provided between the pump frame and the stator.

6. A pump assembly according to claim 1 wherein the pump assembly further includes an outer housing providing a fluid reservoir, the pump housing being contained within the outer housing.

7. A pump assembly according to claim 6 wherein the stator is in fluid communication with fluid in the fluid reservoir.

8. A pump assembly according to claim 1 wherein the pumping member is connected to the motor rotor by means of a drive shaft such that the axis of rotation of the pumping member generally coincides with an axis of rotation of the rotor.

9. A pump assembly according to claim 8 wherein the drive shaft is integral with the pumping member.

10. A pump assembly according to claim 8 wherein the pump housing is provided with an inlet at a first, inlet, end of the pump housing adjacent to the motor, the drive shaft extending from the pumping member through the inlet to the motor.

11. A pump assembly according to claim 1 wherein the pump housing is provided with an inlet at a first, inlet, end of the pump housing adjacent to the motor, the drive shaft extending from the pumping member through the inlet to the motor and a first end portion of the or each auxiliary pumping member extends from the inlet end of the pump housing, and bears against an end plate which is spaced from the pump housing.

12. A pump assembly according to claim 1 wherein the pump housing is provided with an outlet at a second, outlet, end of the pump housing, the outlet being adjacent to an outer outlet port provided in the outer housing, wherein both outlets are centered around the axis of rotation of the main pumping member.

13. A pump assembly according to claim 12 wherein a perforated end plate is provided between the outlet port in the pump housing and the outer outlet port, second end portions of the main and auxiliary pumping members extending from the outlet end of the pump housing and bearing against the perforated plate.

14. A pump assembly including a pump, a pump frame and a motor, the pump including a pumping member which is mounted in a pump housing, relative rotation of the pumping member with respect to the pump housing causing pumping of fluid, and the motor including a rotor and a stator, operation of the motor causing rotation of the pumping member relative to the pump housing, wherein one or two of the stator, pumping member and pump housing is/are fixed relative to the pump frame, a resilient support part being provided between the pump frame and each of the other two or one of the stator, pumping member, and pump housing, the resilient support part or parts permitting movement of the stator, pumping member or pump housing with respect to the pump frame wherein the pumping member is connected to the motor rotor by means of a drive shaft such that the axis of rotation of the pumping member generally coincides with an axis of rotation of the rotor and the pumping member is mounted at a first end of the drive shaft, and a second, opposite end of the drive shaft is located in a bearing, the bearing being mounted on the pump frame and configured to engage with the drive shaft to permit rotation of the drive shaft about its longitudinal axis whilst preventing movement of the drive shaft generally parallel to its longitudinal axis and in the opposite direction to the first end of the drive shaft.

15. A pump assembly according to claim 14 wherein a resilient support part is provided between the bearing and the pump frame.

* * * * *